US006053979A

United States Patent [19]

Bernert et al.

[11] Patent Number: 6,053,979

[45] Date of Patent: Apr. 25, 2000

[54] APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

[75] Inventors: Richard Bernert, Giengen; Friedhelm Ruhl, Steinheim, both of Germany

[73] Assignee: Voith Sulzer Papiermachinen GmbH, Heidenheim, Germany

[21] Appl. No.: 08/979,057

[22] Filed: Nov. 26, 1997

[30] Foreign Application Priority Data

Nov. 29, 1996 [DE] Germany ..... 196 49 559

[51] Int. Cl.[7] ..... B05B 13/02

[52] U.S. Cl. ..... 118/325; 118/419; 118/123

[58] Field of Search ..... 118/325, 419, 118/410, 413, 414, 258, 123, 117, 122

[56] References Cited

U.S. PATENT DOCUMENTS

| | | | |
|---|---|---|---|
| 3,134,126 | 5/1964 | Phillips | 15/256.51 |
| 3,418,970 | 12/1968 | Phelps et al. | 118/413 |
| 4,132,578 | 1/1979 | Gell, Jr. . | |
| 4,502,386 | 3/1985 | Cappel et al. | 101/350 |
| 4,549,933 | 10/1985 | Juda et al. . | |
| 5,074,243 | 12/1991 | Knop et al. | 118/665 |
| 5,108,794 | 4/1992 | Kinnmen | 427/356 |
| 5,264,035 | 11/1993 | Beisswanger et al. | 110/413 |
| 5,269,846 | 12/1993 | Eskelinen et al. | 118/100 |
| 5,660,631 | 8/1997 | Eriksson | 118/118 |
| 5,738,724 | 4/1998 | Cebola et al. . | |
| 5,788,771 | 8/1998 | Madrzak et al. | 118/267 |

FOREIGN PATENT DOCUMENTS

| | | | |
|---|---|---|---|
| 0 146 275 B2 | 7/1990 | European Pat. Off. . | |
| 44 32 179 C1 | 9/1994 | Germany . | |
| 44 32 180 A1 | 3/1996 | Germany | B05B 1/04 |

OTHER PUBLICATIONS

Van Nostrand's Scientific Encyclopedia, Sixth Ed, (1983) Van Nostrand Reinhold Co. Inc. pp. 1627–1632.

*Primary Examiner*—Brenda A. Lamb
*Attorney, Agent, or Firm*—Taylor & Aust, P.C.

[57] ABSTRACT

An apparatus for direct or indirect application of a liquid or pasty coating medium onto a traveling material web, notably of paper or cardboard, includes at least one oblong working unit wetted by the coating medium and an oblong support element carrying the working unit. The at least one working unit and the support element are thermally shielded from one another. The at least one working unit and the support element are joined to one another by way of an elongation compensation system.

2 Claims, 3 Drawing Sheets

APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

BACKGROUND OF THE INVENTION

1. Field of the Invention

The present invention relates to an apparatus for direct or indirect application of a liquid or pasty coating medium onto a traveling material web, notably of paper or cardboard.

2. Description of the Related Art

An apparatus for direct or indirect application of a liquid or pasty coating medium onto a traveling material web is used in so-called coating systems for providing one or both sides of a traveling material web, consisting for example of paper, cardboard or a textile material, with one or several layers of the coating medium, for example color, starch, impregnating fluid or the like. The coating medium may also contain acid or have other aggressive properties.

An apparatus for direct or indirect application of a liquid or pasty coating medium onto a traveling material web, notably of paper or cardboard, is known from German Document No. 44 32 179 C1, assigned to the assignee of the present invention. This apparatus includes an oblong unit which is in direct contact with the coating medium, namely an open-jet nozzle applicator with a feed slot for the coating forming between a front wall arranged on the feed side and a back wall arranged on the leaving side. The apparatus also includes feed conduits by way of which the liquid medium is fed from a central manifold to the feed slot. Further, the apparatus has an oblong support element for the unit, namely a support beam that is joined integrally to the unit and includes the central manifold. Customarily, instead of this integral design, the working unit and the support element are made as separate parts from same materials and secured to one another by means of welding. The working unit and the support element usually have a length of several meters. In the so-called direct application, the liquid or pasty coating medium, as is known, is applied directly onto the surface of the traveling material web, the latter being carried during application on a rotating countersurface, for example an endless belt or a backing roll. In the indirect application of the medium, in contrast, the liquid or pasty coating medium is first applied onto a substrate, for example the surface of a backing roll configured as an applicator roll, and is transferred from the applicator roll to the material web in a nip through which the material web passes.

The coating medium pumped through the apparatus is normally hot as a result of proceeding through various components of the apparatus, passing through circulating devices, or due to the effect of either heating units or drying systems following the working unit. A considerable temperature difference occurs between the hot coating medium, the partial areas of the working unit heated by the coating medium, and the colder support element. The different length changes of these components resulting from the temperature differences create sort of a "bimetal effect" which causes a distortion or flexure of the apparatus structure with respect to the surface being coated and thus, with no suitable countermeasures being taken, appreciable inaccuracies of the applied coating.

Therefore, thermal, mechanical, pneumatic or hydraulic flexure compensation systems (known also as "ADS" or an "Antideflection System") are employed in conventional apparatuses. The systems counteract the above effect and achieve an improved dimensional accuracy of the application across the entire machine width. A support arrangement equipped with a thermal flexure compensation system wherein a temperature-modulating liquid passes through the support element provided with several chambers is described, e.g., in U.S. Pat. No. 3,134,126. Introducing the liquid, temperature-modulated appropriately via a temperature control, achieves a minimum flexure of the doctor beam.

The flexure compensation systems described above, however, are rather expensive in design and, consequently, cost-intensive. The systems also require appreciable expense for measurement and control of regulating technology.

In the prior apparatuses of the type described above the working unit (or major parts of it) and the support element are joined to one another fixedly. Hence, a material pairing adapted to the technique of joining these two components of the apparatus usually required identical materials, which mostly very much limits the designer with respect to material selection. Therefore, material pairings that would have a more favorable effect on the negative flexure behavior explained above, or utilizations of special materials for apparatus areas that are particularly stressed by the coating medium, are normally beyond realization with the prior technologies. Furthermore, the support element and major parts of the working unit associated with it must be fabricated jointly, presupposing large and expensive machinery systems. Lastly, a specific working unit always also requires the manufacture of an exactly adapted specific support element, resulting in higher manufacturing costs.

SUMMARY OF THE INVENTION

The present invention creates a simple and effective apparatus which to the greatest extent possible avoids the disadvantages associated with the prior art (notably flexure), is easily adaptable to different coating conditions, and achieves high quality coating results.

This inventional apparatus for direct or indirect application of a liquid or pasty coating medium onto a traveling material web, notably of paper or cardboard, includes at least one oblong working unit wetted by the coating medium and an oblong support element that carries the working unit. The at least one working unit and the support element are thermally shielded against one another. The working unit(s) and support element are joined to one another by way of a system compensating for elongation.

Meant by a "working unit" in the purport of the invention is a system specific to the application concept, which during processing, manipulation, or application of the coating medium makes direct contact with it. Working units can include, for example, premetering and final metering systems such as an open-jet nozzle applicator including color manifold, feed conduits and nozzle, such as known by the trade name "JetFlow F" applicators with an application chamber, so-called "Short Dwell Time Applicators" (SDTA), "Long Dwell Time Applicators," leveling systems or final metering systems with one or several doctor elements and the like. The working unit, of course, may include various assemblies or parts, guaranteeing, when needed, replacement or maintenance of these components, specifically of the parts subject to high wear. Serving as a support element, for example, is a support beam configured as an oblong hollow element and including a suitable base or surface for mounting the working unit. Accurate joining of working units and support element will be addressed in more detail yet hereinafter.

The inventors of the present applicational object recognized that the unfavorable flexure phenomena occurring with conventional apparatuses can be effectively minimized or even avoided completely in an easy and effective way by physical separation of the working unit parts wetted by the coating medium from the support element and by providing a thermal shielding between these components which are joined to one another by way of a system compensation for elongation. This positive effect is further improved with a combination of the thermal shielding and the elongation compensating system.

For example, the thermal shielding prevents a thermal transmission from the working unit to the support element and thus prevents a deformation of the support element itself caused by support element areas being heated to different temperatures. The elongation compensating system fixedly joins the working unit and support element to one another but at the same time allows an unhindered elongation of these two components in their longitudinal direction relative to each other. Heat from the hot coating medium resulting in an elongation of the working unit can be prevented from being transmitted to the support element (or vice versa) and causing a deformation or flexure of the apparatus structure. This even makes it possible to arrange several working units on the same support element. In prior designs, a separate support element had to be coordinated with each working element. The inventional apparatus is dimensionally very stable, despite the considerable lengths of working unit and support element and despite the temperature differences occurring during operation, and operates precisely even without additional measures. Therefore, the use of relatively laborious and expensive flexure compensation systems is normally dispensable. Nonetheless, flexure compensation systems are still usable in conjunction with the apparatus according to the invention. Owing to the dimensional stability of the inventional apparatus and the lower output demand of the flexure compensation system as compared to prior apparatuses, however, such systems allow a considerable size reduction and simplification. The simplified design of the inventional apparatus has a favorable effect on the manufacturing expenditures and the associated manufacturing costs.

Owing to the specific separation between the at least one working unit and the support element as described above, enhanced options present themselves in the material selection for these components. For example, special materials, notably acid-resistant materials, could now be used for the working unit parts wetted by the coating medium. Such special materials have thus far been unusable due to the fusion joining between working unit and support element. Especially the chemical, mechanical and thermal properties of these apparatus components can be optimized in this way.

Suitable configuration of the separate support element and the respective working unit, moreover, allows an enhanced degree of standardization, since an individual support element type is usable for different working units. The manufacture of the working unit and of the support element can now be carried out independently of one another and on smaller production machines, allowing a more flexible and cost-effective manufacture.

A design feature of the invention provides for the thermal shielding to include at least one thermal insulation layer arranged between the working unit and the support element. This layer may be air, a separate part, or a coating applied on the support element and/or the working unit. The configuration of the insulating layer can be adapted to the respective geometry of the associated faying surfaces of the working unit and of the support element. The insulating layer may also assume sealing functions.

When using air as thermal insulation layer, it can be moved by a fan, which improves the shielding effect.

A fixed-bearing/movable-bearing assembly including at least one movable bearing by way of which the working unit and the support element are joined has proved particularly suitable for an elongation compensation system. This variant is easy to realize in terms of engineering.

In a further embodiment of the apparatus, the elongation compensating system is configured as a linear guideway that extends essentially parallel to the longitudinal direction of the working unit and the support element and joins the working element and the support element to one another while allowing for thermal shielding. The linear guideway, for example, may be a grooving provided on the associated faying surfaces of the working unit and the support element and extending essentially parallel to their longitudinal directions. The grooving allows an unimpeded elongation of these two apparatus components relative to each other.

Nonetheless, the invention is not geared solely to the two specific elongation compensation systems illustrated above. Other suitable elongation compensation systems are possible just as well, for example, by way of webs distributed in the longitudinal direction and serving as connection between one of the working units and the support element. The webs compensate for any different elongations and are optimizable with respect to the transmission of moments and thermal conductance.

The at least one working unit and the support element can be detachably joined, allowing easy separation for purposes of maintenance or replacement by another working unit. Resulting thereof are a further economization of assembly and maintenance work as well as the option of combining most varied working units with a single support element type.

In a further embodiment of the inventional apparatus, the at least one working unit and the support element are joined movably relative to one another in a direction essentially parallel to their longitudinal expanse.

This embodiment suggests itself specifically in conjunction with the linear guideway described above and allows an easier compensation for manufacturing tolerances. The embodiment also allows adjustment of the working unit in the machine cross direction with respect to the support element or to a backing roll opposite the working unit. Additionally, the embodiment allows a continuous or discontinuous moving of the working unit during the operation of the apparatus, for example for manipulation of the coating produced with the working unit. In this context it also has proved positive to mount the working unit on the support element in a manner allowing oscillating motion in a direction essentially parallel to its longitudinal expanse. Provided for performance of the oscillating motion are appropriate drive systems which act directly or indirectly on the working unit and drive it. The drive may be coupled to a suitable control and/or regulating system.

When the working unit, e.g., is a system including a doctor element for cleaning, the continuous, discontinuous or oscillating movement of the working unit allows an appreciable improvement of the achievable cleaning effect. In the case of a doctor element for application or final metering, the oscillating movement allows a considerable reduction and equalization of the local doctor element wear, which usually is elevated at the transition points between the coated and uncoated edge, and thus a prolonged service life.

As compared to the prior art, this also allows longer maintenance intervals up to the required replacement of the doctor element, which in turn avoids extended downtimes of the inventional apparatus and lower overall operating costs.

For specific applications and material combinations it has proved possible, according to a further embodiment of the invention, to make the working unit and support element of materials with identical or essentially identical coefficients of thermal expansion. This has a further positive effect on the flexure performance of the working unit and the support element.

Due to the specific design of the inventional apparatus as described above, the working unit (F) and the support element may consist of materials with very different coefficients of thermal expansion without inviting a negative effect on the overall flexure performance of these two apparatus components. Thus, the embodiment described here represents merely a special case.

Lastly, according to another embodiment, the support element is made of a fiber-composite material, such as CFP (carbon-fiber-reinforced plastic) or GFP (glass-fiber-reinforced plastic). The support element can be a single-piece component, having, for example, a circular cross section. The support element can be made facultatively by known manufacturing processes such as, for example, filament winding or the laying of prepreg webs. Regarding flexure, other cross sections may also be chosen, for example polygonal with three to eight side surfaces.

In this context, allowance should be made for the fact that, e.g., a joining surface or mounting base of the support element coordinated with the respective working unit can very well be made, due to manufacturing-related requirements, first as a separate fiber-composite part and thereafter joined to the main body of the support element.

Support elements of that type have proven themselves due to their neutral temperature and elongation performance as well as their low weight. A near zero thermal elongation in the longitudinal direction of the support element can be achieved notably by suitable selection of the fiber content and major fiber orientation. Thus, the fiber-composite material allows optimization such that a minimal dependence of the flexure is assured at varying temperature conditions.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
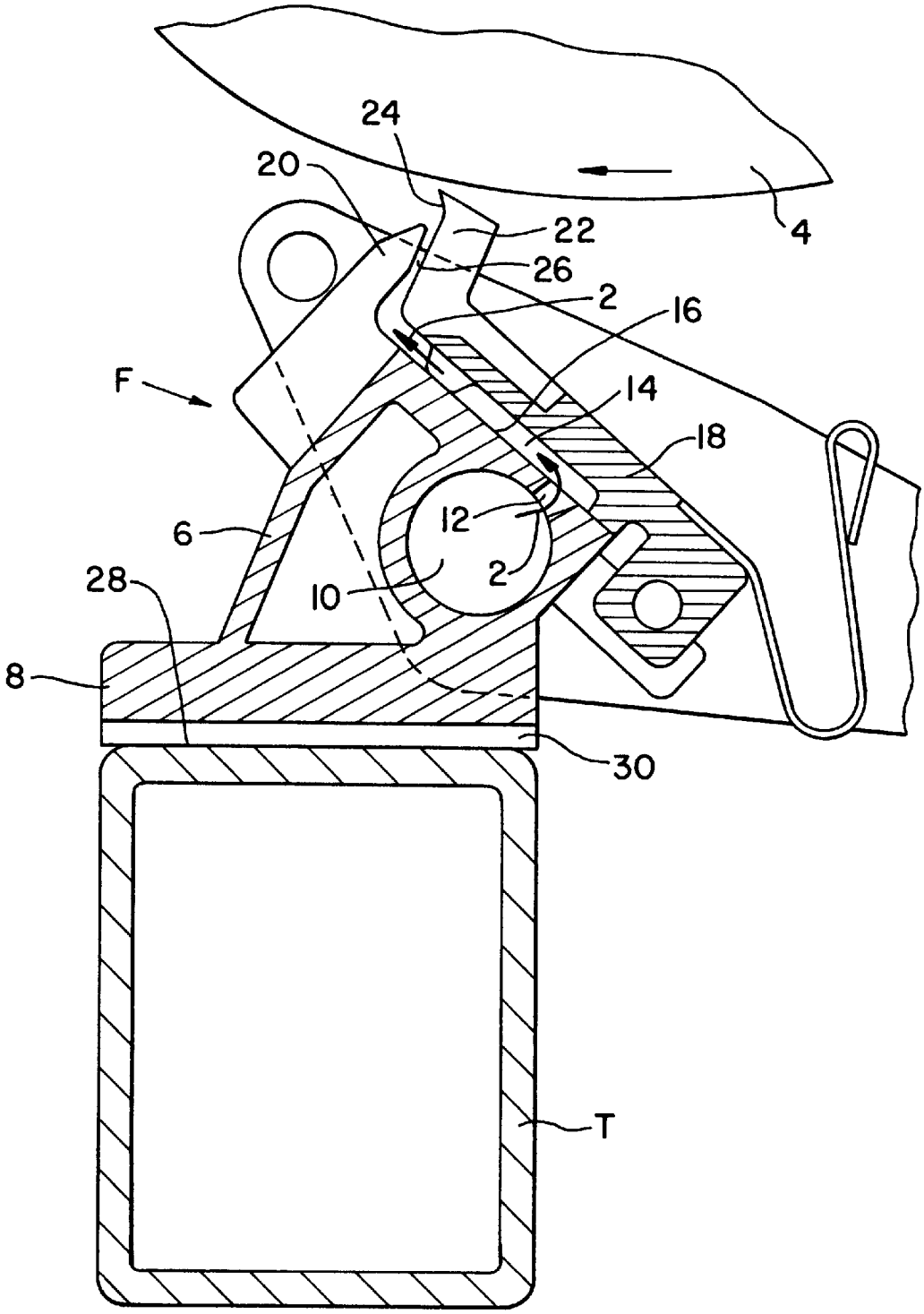
FIG. 1 shows a schematic, side, sectional view of one embodiment of the inventional apparatus with a working unit.

Referring now to the drawings, and more particularly to FIG. 1, there is shown the inventional apparatus for direct or indirect application of a liquid or pasty coating medium 2 onto a traveling material web, notably of paper or cardboard. The apparatus includes a multiple-part working unit F supported by an oblong support element T, namely a support beam T configured as a hollow element. Working unit F is an open-jet nozzle applicator opposing a backing roll 4 serving in the case of indirect application as a substrate for the coating medium 2 and in the case of direct application as support surface for the material web running on backing roll 4. The direction of rotation of backing roll 4 is indicated by an arrow.

Working unit F includes a base element 6 with a base 8 coordinated with support element T as well as a manifold 10 feeding the liquid or pasty coating medium 2. The coating medium 2 proceeds from manifold 10 via a plurality of feed conduits 12 to a feed slot 14 extending between a side wall 16 of the base element 6 and a front panel 18 hinged to it. Coating medium 2 proceeds from there into a metering slot 26 forming between two lips 20, 22, of which the lip 22 facing backing roll 4 has a concave guide surface 24. Metering slot 26 is configured as an open-jet nozzle from which the coating medium 2 ultimately exits as an open jet. The support element T is made of a carbon-fiber plastic and has a rectangular cross-sectional shape. Support element T has a flat top side 28 coordinated with base 8 of working unit F.

Working unit F is heated by the coating medium 2, which is hot during operation of the apparatus. Working unit F is thermally shielded from support element T by an insulating layer 30 arranged between base 8 and the flat top side 28. The insulating layer 30 is made of a panel-like insulating material. The working unit F and the support element T are fixedly but detachably joined to one another by way of an elongation compensation system not shown in FIG. 1 but visible in FIG. 2 in the form of a linear guideway L. The elongation compensation system allows an unimpeded elongation of these two apparatus components F and T in their longitudinal direction relative to one another.

Figure 2:
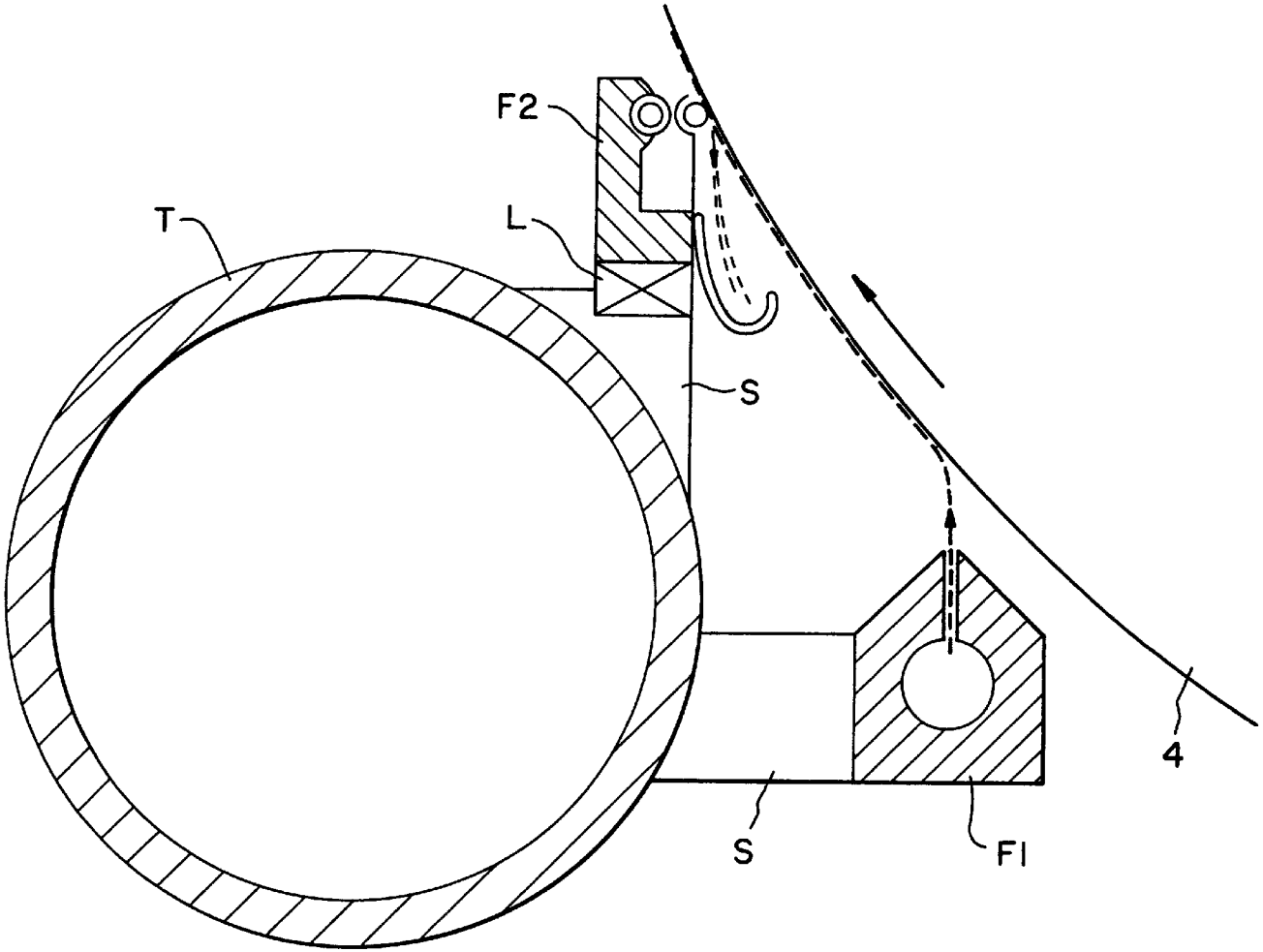
FIG. 2 is a schematic, side, sectional view of another embodiment of the inventional apparatus with two working units.

Visible in FIG. 2 is a support beam T that has a circular cross section and two working units F1 and F2 coordinated with it. F1 is an open-jet nozzle applicator known as such. In keeping with given requirements, of course, another suitable applicator may also be used, as explained previously. F1 is joined to the support beam T, e.g., by way of webs S. Functioning as a leveling system is a working unit F2, smoothing the applied medium.

Linear guideway L is provided as an elongation compensation system between F2 and support beam T. Of course, L and S may also be coordinated with the other working unit F1, separately or in combination. A fixed-bearing/movable-bearing assembly including at least one movable bearing by way of which the working unit and the support element are joined can be used as an elongation compensation system.

Figure 5:
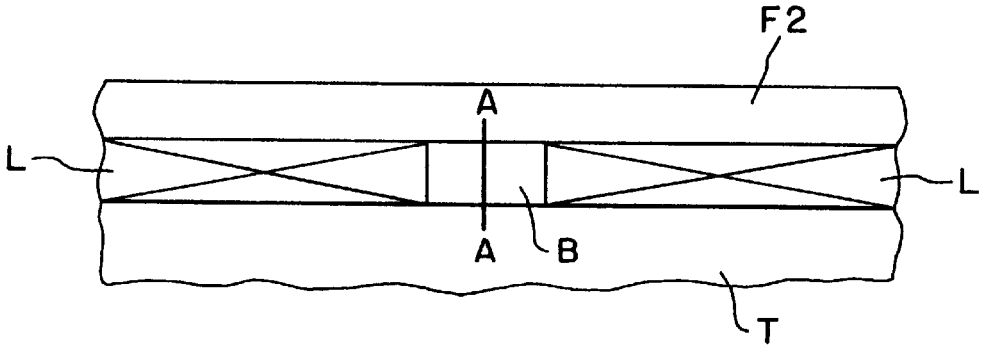
FIG. 5 is a schematic, sectional, fragmentary view of the application apparatus of FIG. 2.

FIG. 5 is a schematic, sectional, fragmentary view of the application apparatus of FIG. 2. A bearing B, referred to as a "fixed bearing," is screwed, welded, or otherwise fixedly attached to a mid-portion of linear guideway L, referred to as a "movable bearing." The fixed-bearing/movable-bearing assembly formed by bearing B and linear guideway L is limitedly rotatable about axis A—A. In this way, the fixed-bearing/movable-bearing assembly can compensate for any non-parallelism between working unit F2 and support element T.

Figure 3:
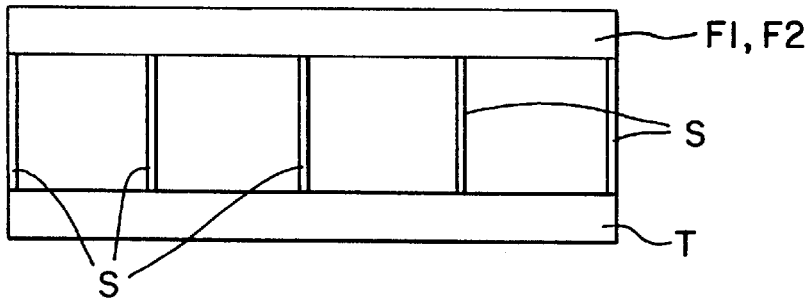
FIG. 3 is a schematic plan view of an inventional elongation system.
Figure 4:
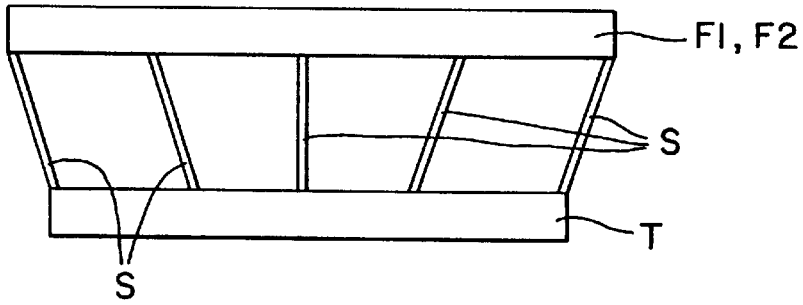
FIG. 4 is the elongation according to FIG. 3.

The invention is not limited to the above exemplary embodiments, which serve merely the general explanation of the basic idea of the invention. Instead, the inventional apparatus may within the scope of protection also assume forms of embodiment other than those described above. In particular, the apparatus may possess features which constitute a combination of the respective individual features. Moreover, the support element T may have cross-sectional shapes deviating from the above exemplary embodiment relative to FIG. 2, for example oval, triangular or other polygonal forms as well as mixed forms thereof. Similarly, the thermal insulating layer 30 may have a different design adapted to the respective geometry of working unit F, of support element T and their joining system. A different type of thermal shielding may also be chosen. In FIGS. 3 and 4, the thermal shielding consists of air (also movable) between the webs S connecting the respective working unit F1 and/or F2 to the support element T. FIG. 4 illustrates for clarification the elongation of the working unit F and webs 3 compensating for the elongation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for one of direct and indirect application of a coating medium onto a traveling fiber material web having a width, said apparatus comprising:

at least one oblong working unit configured for being wetted by the coating medium and applying the coating medium onto the web, said at least one working unit being associated with the web and having a longitudinal direction substantially parallel to the width of the web;

an oblong support element supporting at least one said working unit and extending substantially parallel to said longitudinal direction;

means for thermally shielding said at least one working unit and said support element from one another; and an elongation compensation system interconnecting said at least one working unit and said support element, said elongation compensation system comprising a fixed-bearing/movable-bearing assembly including at least one movable bearing.

2. The apparatus according to claim 1, wherein said elongation compensation system comprises a linear guideway extending substantially parallel to said longitudinal direction of said at least one working unit, said guideway interconnecting said at least one working unit and said support element.

* * * * *